US010094067B2

(12) United States Patent
Pitkäniemi et al.

(10) Patent No.: US 10,094,067 B2
(45) Date of Patent: Oct. 9, 2018

(54) PRODUCTION LINE FOR PRODUCING FIBER WEBS AND A COOLER

(71) Applicant: Valmet Technologies Oy, Espoo (FI)

(72) Inventors: Tapio Pitkäniemi, Haarajoki (FI); Mika Vijanmaa, Helsinki (FI); Jari Ilomäki, Helsinki (FI)

(73) Assignee: VALMET TECHNOLOGIES, INC., Espoo (FI)

( * ) Notice: Subject to any disclaimer, the term of this patent is extended or adjusted under 35 U.S.C. 154(b) by 0 days.

(21) Appl. No.: 15/484,025

(22) Filed: Apr. 10, 2017

(65) Prior Publication Data

US 2017/0292221 A1 Oct. 12, 2017

(30) Foreign Application Priority Data

Apr. 11, 2016 (EP) ..... 16164652

(51) Int. Cl.
*D21G 1/00* (2006.01)
*D21F 7/00* (2006.01)
*D21F 9/00* (2006.01)

(52) U.S. Cl.
CPC ..... *D21F 7/00* (2013.01); *D21F 9/00* (2013.01); *D21G 1/00* (2013.01); *D21G 1/0093* (2013.01)

(58) Field of Classification Search
CPC ... D21F 9/00; D21F 5/187; D21F 7/00; D21F 5/188; D21G 1/0093; D21H 25/04
See application file for complete search history.

(56) References Cited

U.S. PATENT DOCUMENTS 3,838,000 A * 9/1974 Urbas ..... D21G 7/00 162/207
4,274,210 A * 6/1981 Stengard ..... B65H 23/24 226/196.1
4,975,108 A * 12/1990 Pruitt ..... A01N 25/10 34/370
6,207,020 B1 3/2001 Anderson
(Continued)

FOREIGN PATENT DOCUMENTS

DE 102005053968 A1 5/2007
DE 202013011389 U1 * 1/2014 ..... D21F 11/00
(Continued)

OTHER PUBLICATIONS

The Extended European Search Report for EP 16164652, dated Oct. 24, 2016.

*Primary Examiner* — Jose A Fortuna
(74) *Attorney, Agent, or Firm* — Stiennon & Stiennon

(57) ABSTRACT

A cooler (144) providing gas blows and comprising at least one cooler module having at least one cooler module (41, 42, 43, 44) of the cooler (144) is curved to provide a gas turn module for turning run of the fiber web (W) from its main running direction 80-190°. The cooler (144) includes moisturizing at least one surface of the fiber web. Having a blowing zone (45, 46, 53) in which gas is blown toward a surface of the fiber web and that the cooler comprises at least one suction zone (51), in which the fiber web evaporated moisture is drawn away from the proximity of a surface of the fiber web. There are cooler modules on both sides of the fiber web. The cooler has a gas turn module located inside a curved fiber web run, which provides gas blows toward the curved fiber web during the run.

8 Claims, 4 Drawing Sheets

(56) References Cited

U.S. PATENT DOCUMENTS

| | | | | |
|---|---|---|---|---|
| 7,125,473 | B2 * | 10/2006 | Anderson | D21F 5/042 162/263 |
| 8,486,229 | B2 * | 7/2013 | Pietikainen | D21F 5/004 162/280 |
| 9,322,135 | B2 * | 4/2016 | Pietikainen | D21H 25/04 |
| 2001/0008181 | A1 * | 7/2001 | Anderson | D21G 1/0093 162/204 |
| 2005/0056392 | A1 * | 3/2005 | Anderson | D21F 5/042 162/199 |
| 2012/0111516 | A1 * | 5/2012 | Tynkkynen | D21G 1/0093 162/133 |
| 2012/0125554 | A1 * | 5/2012 | Pietikainen | D21F 5/004 162/280 |
| 2015/0136349 | A1 * | 5/2015 | Pietikainen | D21H 25/04 162/206 |
| 2017/0292221 | A1 * | 10/2017 | Pitkaniemi | D21F 7/00 |

FOREIGN PATENT DOCUMENTS

| | | | | |
|---|---|---|---|---|
| DE | 202015105426 | U1 * | 10/2015 | D21G 1/0093 |
| DE | 202015105426 | U1 | 12/2015 | |
| EP | 2682520 | A1 | 1/2014 | |
| EP | 2876206 | A1 | 5/2015 | |
| EP | 3012371 | A1 * | 4/2016 | D21G 1/0093 |
| EP | 3012371 | A1 | 4/2016 | |
| EP | 2682520 | B1 * | 6/2016 | D21G 1/0093 |
| EP | 2765237 | B1 * | 11/2016 | D21F 11/00 |
| EP | 3231937 | A1 * | 10/2017 | D21F 7/00 |
| WO | 0070144 | A1 | 11/2000 | |
| WO | WO-02095125 | A1 * | 11/2002 | D21F 5/02 |
| WO | WO-2010136651 | A1 * | 12/2010 | D21F 5/004 |

* cited by examiner

PRODUCTION LINE FOR PRODUCING FIBER WEBS AND A COOLER

CROSS REFERENCES TO RELATED APPLICATIONS

This application claims priority from EP16164652 which was filed on Apr. 11, 2016, and is incorporated herein by reference.

STATEMENT AS TO RIGHTS TO INVENTIONS MADE UNDER FEDERALLY SPONSORED RESEARCH AND DEVELOPMENT

Not applicable.

BACKGROUND OF THE INVENTION

In general the present invention relates to a cooler having at least one cooler module of the cooler which is curved to provide a gas turn module for turning run of the fiber web from its main running direction 80-190°.

As known from the prior art, fiber web producing processes typically comprise an assembly formed by a number of apparatuses arranged consecutively in the process line. A typical production and treatment line comprises a head box, a wire section and a press section as well as a subsequent drying section and a reel-up. The production and treatment line can further comprise other devices and/or sections for finishing the fiber web, for example, a pre-calender, a sizer, a final-calender, a coating section. The production and treatment line also typically comprises at least one slitter-winder for forming customer rolls as well as a roll packaging apparatus or a sheet cutter.

One problem with production of fiber webs is to achieve required surface properties and simultaneously achieve required bulkiness i.e. the relation of thickness of the web to its grammage (basis weight). When the fiber web has high bulkiness the basis weight can be reduced which results in considerable savings in raw material. Typically the fiber web is guided from the drying section to a pre-calender, when the temperature of the fiber web is about 80-90° C. In the thickness direction of the web the middle layers of the web are hot and near plastic state, whereby during calendering the fiber web will compact also in the middle layers, which leads to bulk loss. It is known from prior art that bulkiness can be saved in calendering by cooling the fiber web before calendering.

An object of the invention is to create a production line which is simple, cost effective and raw material saving for producing board and paper webs with high production capacity.

A further object of the present invention is to approach the above problems from a new point of view and to suggest novel solutions contrary to conventional modes of thinking.

SUMMARY OF THE INVENTION

The cooler according to the invention is mainly characterized by having at least one cooler module of the cooler which is curved to provide a gas turn module for turning run of the fiber web from its main running direction 80-190°.

Advantageous embodiments and features of the cooler include moisturizing at least one surface of the fiber web. Having at least one blowing zone, in which dry cool gas is blown towards at least one surface of the fiber web and that at least one cooler module of the cooler comprises at least one suction zone, in which from the fiber web evaporated moisture is drawn away from the proximity of at least one surface of the fiber web. There are cooler modules on both sides of the fiber web. The cooler has a gas turn module located inside a curved fiber web run, which gas turn module provides gas blows towards the curved fiber web during the run.

The production line according to the invention advantageously comprises at least one head box, forming each layer or for layer combinations, a press section, a drying section, at least one cooler providing gas, for example air or air-mixture or gas-mixture, blows after the press section, at least one moisturizing device located before at least one cooler providing gas blows, at least one calender, a reel-up, a slitter-winder and/or a sheet cutter.

According to an advantageous feature of the invention the production line further comprises a moisturizing device located before the cooler providing gas blows.

According to an advantageous embodiment of the invention the production line further comprises a Yankee cylinder and/or a belt arrangement, a size press and an after drying section located after the Yankee cylinder and/or the belt arrangement and/or after the size press and/or after the calender.

According to an advantageous embodiment of the invention the production line further comprises a coating section for coating the fiber web by 1-4 layers of coating and dryer for drying the coating.

The production speed of the production line is advantageously 100-2000 m/min.

The basis weight of the fiber web produced by the production line is 50-1000 g/m$^2$.

The end product of the production line is a fiber web with 1-10 fiber layers. The end product of the production line is a fiber web with 1-6 coating layers.

According to the invention between at least one calender of the production line and the last drying cylinder before it is a non-contacting device for cooling the fiber web is located and length of the fiber web run between the at least one calender and the production equipment before it is 7-20 m, advantageously 10-15 m. The length is measured from the last contact point of the fiber web on the last drying cylinder before the calender next to it and the first contact point of the fiber web on the first calender roll forming the first calender nip of the calender. The production equipment before the calender is advantageously the last drying cylinder of the drying section.

According to an advantageous feature of the invention temperature of the cool gas of the cooler is lower than temperature of the fiber web entering the cooler which provides the cool gas in gas blows.

According to an advantageous feature of the invention the cooler comprises a blower blowing dry, cool gas towards at least one surface of the fiber web such that partial pressure of steam is remarkably greater than the partial pressure of steam in the gas blown by the cooler providing gas blows, such that when partial pressure of the steam in the fiber web is 100% the partial pressure of the steam and the gas blown by the cooler providing gas blows is less than 70% partial pressure of the steam.

According to the invention the cooler providing gas blows comprises at least one cooler, advantageously an impingement drying, module.

According to an advantageous feature of the invention at least one cooler module is curved.

According to an advantageous feature of the invention the cooler providing gas blows may comprise moisturizer for moisturizing at least one surface of the fiber web.

According to an advantageous feature of the invention in the cooler providing gas blows at least one impingement drying module is provided as a gas turn module for turning run of the fiber web from horizontal direction 80-190°.

According to an advantageous feature of the invention at least one cooler module comprises at least one blowing zone, in which dry, cool gas is blown towards at least one surface of the fiber web.

According to an advantageous feature of the invention at least one cooler module comprises at least one suction zone, in which from the fiber web evaporated moisture is drawn away from the proximity of at least one surface of the fiber web.

According to an advantageous feature of the invention the cooler comprises coolers, advantageously impingement drying modules on both sides of the fiber web.

According to an advantageous feature of the invention the cooler comprises a gas turn module located inside the curved fiber web run, which gas turn module comprises gas blows directed towards the curved fiber web during the run. By this the cooler can be constructed compactly.

According to an advantageous feature of the invention the impingement drying module has a pressure over ambient pressure inside the module such that gas flows outside preventing the moisture from the fiber web to enter inside the module.

According to an advantageous feature of the invention the cooler module comprises blowers provided in the module and/or integrated to a channel connected to the cooler module.

According to an advantageous feature of the invention the temperature of the cool gas of the cooler providing gas blows is adjustable.

According to an advantageous feature of the invention the head box is a two or a three layer head box.

According to an advantageous feature of the invention the press section comprises at least one roll press nip and/or at least one shoe press nip.

According to an advantageous feature of the invention the drying section comprises at least one drying cylinder group with one wire draw and/or at least one drying cylinder group with twin wire draw.

According to an advantageous feature of the invention the calender is a pre- or an intermediate or an end calender.

According to an advantageous feature of the invention the size press is a bond sizer or a spray sizer or a film sizer.

According to an advantageous feature of the invention the after coating section comprises at least one of the following: a bond coater, an air brush coater, a sizer, a blade coater, a rod coater, a curtain coater, a spray coater, a cast coater.

According to an advantageous feature of the invention the moisturizing device of the production line comprises a suction zone that extends to the substantial width of the fiber web located advantageously between moisturizing nozzles of the moisturizing device and outlet end of the moisturizing device.

According to an advantageous feature of the invention the outlet end of the moisturizing device comprises a nozzle for sealing blow.

According to an advantageous feature of the invention inner surfaces of the moisturizing device susceptible for moisture adherence are directed at least 15° downwards.

According to an advantageous feature of the invention at least part of the inner surfaces of the moisturizing device that is hydrophilic are roughened by sand blowing.

According to an advantageous feature of the invention at lower most point of the moisturizing device a drain connection is located or the moisturizing devices provided with a drop protrusion.

Paper and board are available in a wide variety of types and can be divided according to basis weight in two grades: papers with a single ply and a basis weight of 25-300 g/m$^2$ and boards manufactured in multi-ply technology and having a basis weight of 150-600 g/m$^2$. It should be noted that the borderline between paper and board is flexible since board grades with lightest basis weights are lighter than the heaviest paper grades. Generally speaking, paper is used for printing and board for packaging. The present invention relates especially to producing boards for inner or outer board grades of packages. The main cartonboard grades are folding boxboard (FBB), white-lined chipboard (WLC), solid bleached board (SBS) and liquid packaging board (LPB). In general, these grades are typically used for different kinds of packaging of consumer goods. Cartonboard grades vary from one to up to five-ply boards (150-400 g/m$^2$). The top side is usually coated with from one to three layers (20-40 g/m$^2$), the back side has less coating or no coating at all.

There is a wide range of different quality data for the same board grade. FBB has the highest bulk thanks to the mechanical or chemomechanical pulp used in the middle layer of the base board. The middle layer of WLC consists mainly of recycled fiber, whereas SBS is made from chemical pulp, exclusively. FBB's bulk typically is between 1.1-1.9 cm3/g whereas WLC is on range 1.1-1.6 cm3/g and SBS 0.95-1.3 cm3/g. The PPS-s10-smoothness is respectively for FBB between 0.8-2.1 μm, for WLC 1.3-4.5 μm and for SBS 0.7-2.1 μm. Containerboard, also referred to as CCM or corrugated case material, is a type of paperboard specially manufactured for the production of corrugated board. The term encompasses both linerboard and corrugating medium (or fluting), the two types of paper that make up corrugated board. Liners are divided according to their furnish base into kraftliner, recycled liner and white top liner. Liners are typically 1 to 3 ply boards with grammages varying in the range 100-300 g/m$^2$. Liner-boards are generally uncoated, but the production of coated white-top liner is increasing to meet higher demands for printability.

BRIEF DESCRIPTION OF THE DRAWINGS

In the following paragraphs the invention is further explained in detail with reference to the accompanying drawings in which.

DESCRIPTION OF THE PREFERRED EMBODIMENTS

Figure 1:
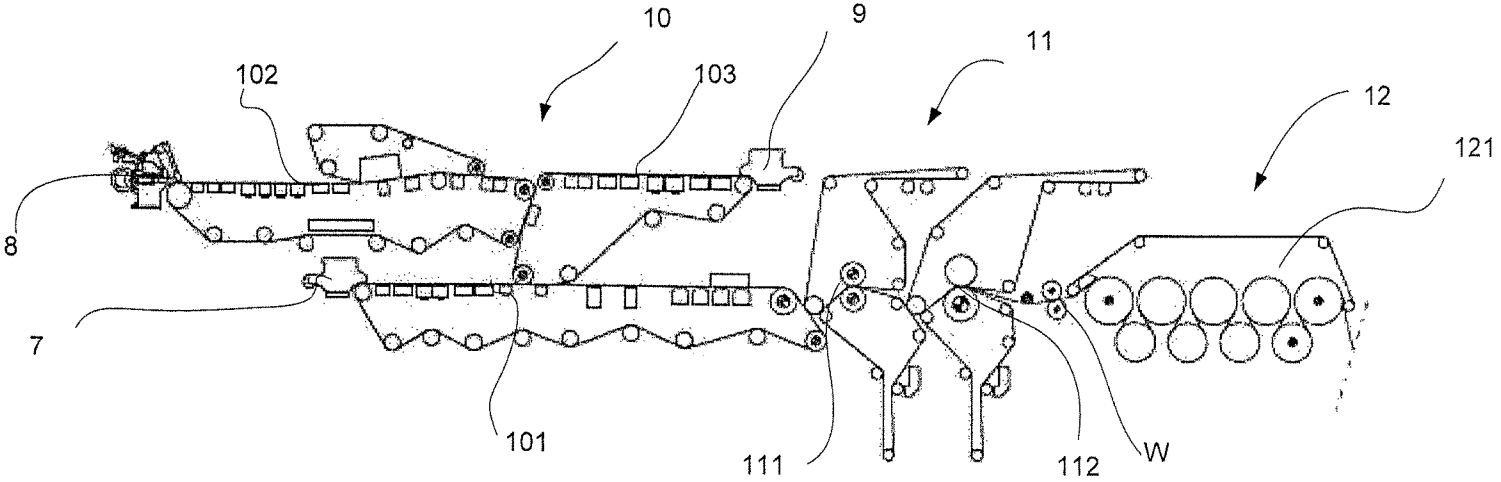
FIGS. 1-4 are schematically shown side elevational views of an advantageous example of a production line for producing fiber web according to the invention.
Figure 2:
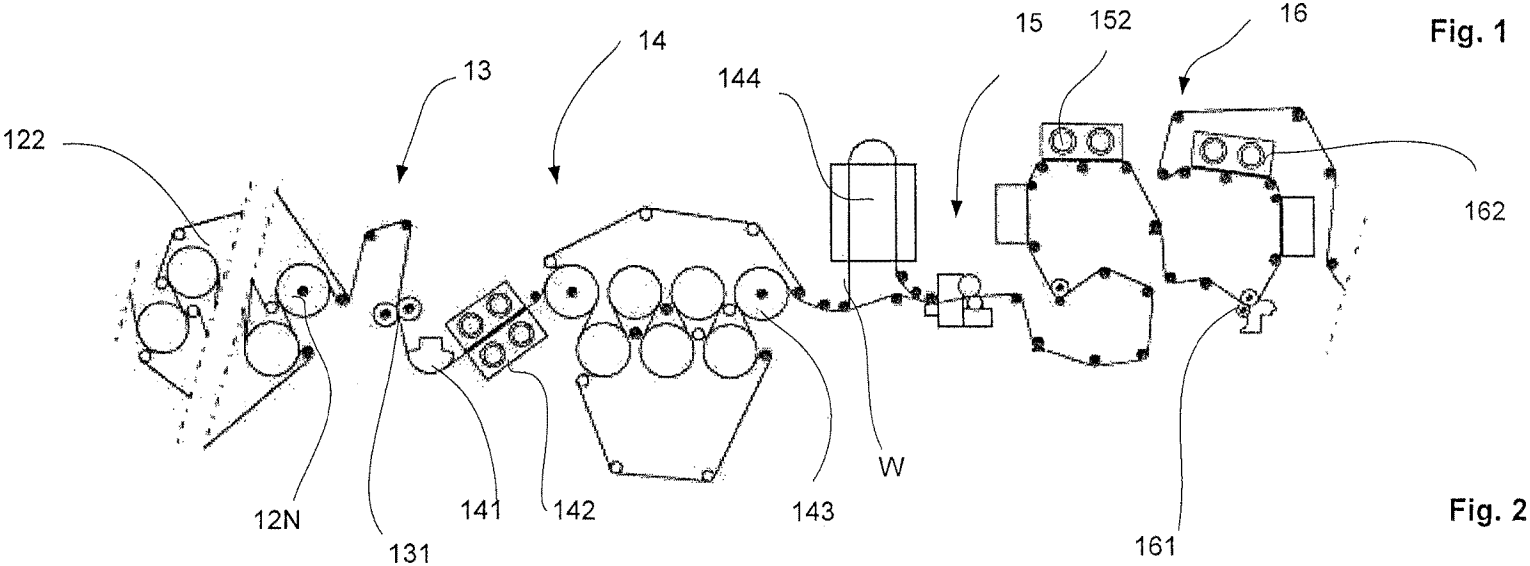
Figure 3:
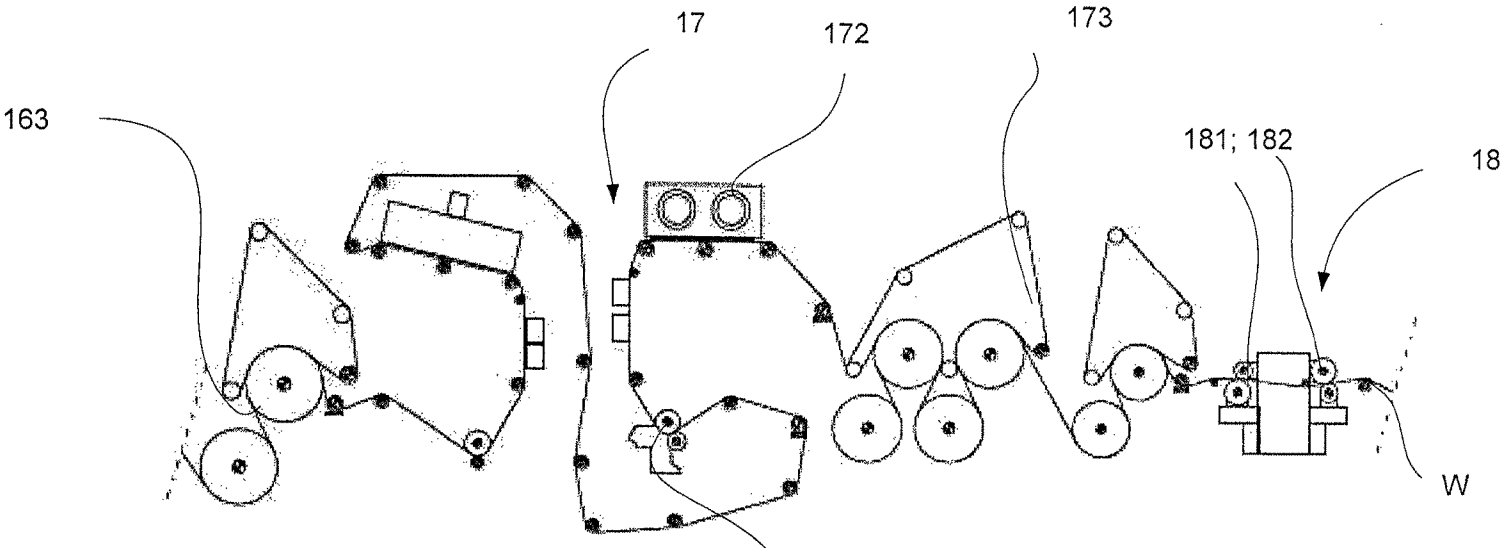
Figure 4:
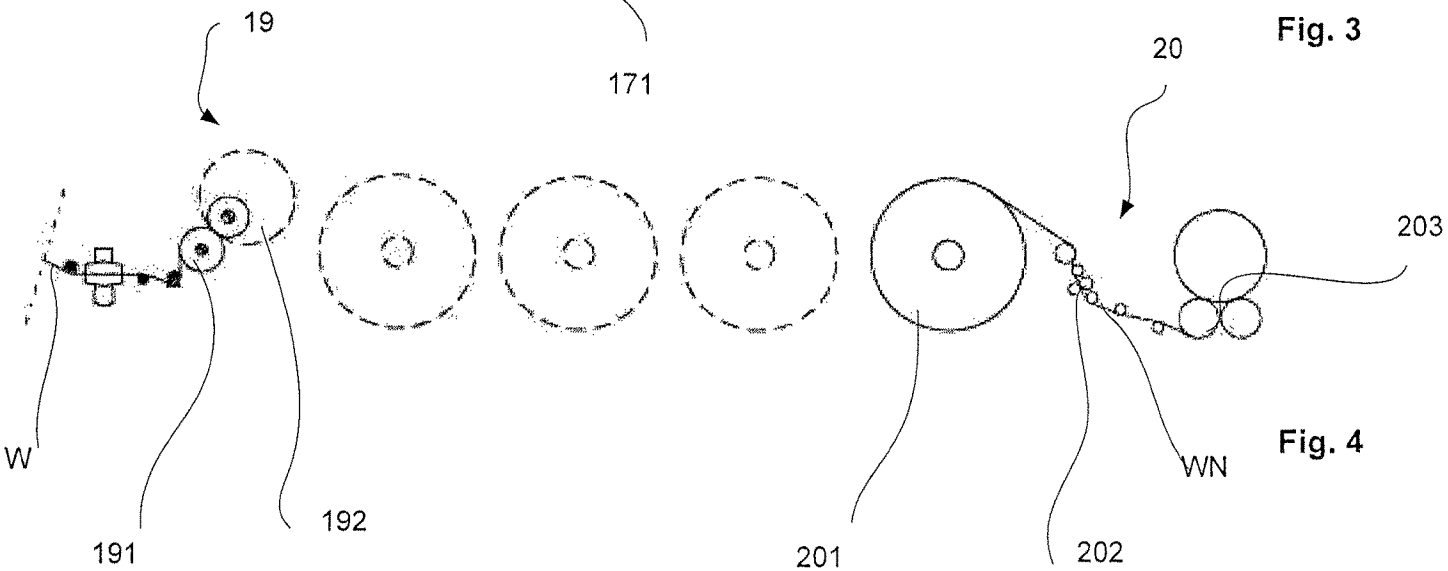

In the following disclosure and the accompanying drawings corresponding parts, part components, sections etc. are marked by the same reference signs unless otherwise mentioned. Further it is to be noted that in the figures some of the reference signs for details of parts, part components, sections have been omitted for clarity reasons as these details are well known to one skilled in the art.

In the schematic example of a production line for producing coated fiber webs, in particular coated board webs as shown in FIGS. 1-4 the production line for producing fiber webs comprises three head boxes 7, 8, 9 each for providing furnish for one fiber layer of the fiber web W and each followed by a forming unit 101, 102, 103 in a forming section 10 of the production line, in which forming section the fiber web W is formed and moisture is removed from the fiber web. In a press section 11 the fiber web W is pressed in press nips 111, 112. A drying section 12 of the production line comprises traditional drying in drying cylinder group(s) 121 of one-wire draw and/or in drying cylinder group(s) 122, 12N of twin-wire draw. The drying section 12 is followed by a size press 131 of a sizing section 13, which comprises a drying section 14 for the size, which drying section comprises a turning device 141, non-contact-dryer 142, and drying cylinder group 143 with twin-wire draw. After the drying section 14 for the size is provided a cooler 144. After the cooler 144 the fiber web is calendered in a calendering nip formed between two calender rolls in a calender 15 followed by drying by a non-contact dryer 152. There after the fiber web W is coated in coating section 16, 17, which provides coating for two coating layers by coaters 161, 171. Each coater 161, 171 is followed by a drying section comprising non-contact dryers 162, 172 and/or a drying cylinder group 163, 173. After the coating section an end calender 18 is located, in which the fiber web W is calendered in two calendering nips 181, 182 formed between calender rolls. At the end of the production line the fiber web W is reeled to a parent roll 192 having full width fiber web in a reel-up 19 by a reeling cylinder 191. The parent rolls 192 are transferred to an unwinder 201 of the slitter-winder 20. The unwound full width fiber web W is cut in longitudinal direction of the fiber web W i.e. slitted in a slitter 202 to partial fiber webs WN by slitter blades and the partial fiber webs WN are wound to partial fiber web rolls i.e. customer rolls in a winder 203.

These devices and sections can be constructed in various different designs and constructions known as such to one skilled in the art. Advantageously the head box is a two or a three layer head box 7, 8, 9, the press section comprises at least one roll press nip 111 and/or at least one shoe press nip 112, the drying section comprises at least one drying cylinder group 121 with one wire draw and/or at least one drying cylinder group 122, 12N with twin wire draw and the size press 131 is a bond sizer or a spray sizer or a film sizer.

The production line comprises at least one cooler 144 providing gas blows after the press section, at least one moisturizing device located before at least one cooler 144, at least one calender 15, a reel-up 19, a slitter-winder 20 and/or a sheet cutter. The cooler 144 comprises blower to direct dry, cool gas toward at least one surface of the fiber web W. Many different kinds of calenders 15 can be used as a pre-calender and/or as an intermediate and/or as an final calender, for example hard nip calenders, soft nip calenders, supercalenders, metal belt calenders, shoe calenders, long nip calenders, multi-nip calenders.

The production line can further comprise a Yankee cylinder and/or a belt arrangement, a size press 131 and an after drying section 14, 152 located after the Yankee cylinder and/or the belt arrangement and/or the size press and/or the calender 15 and a coating section 16, 17 for coating the fiber web by 1-4 layers of coating and non-contact dryers for drying the coating. The coating section 16, 17 comprises at least one coater 161, 171 of the following: a bond coater, an air brush coater, a sizer, a blade coater, a rod coater, a curtain coater, a spray coater, a cast coater.

Between the calender 15 of the production line and the last drying cylinder before it a non-contacting cooler for cooling the fiber web i.e. the cooler 144 providing cool gas is located and length of the fiber web run between last contact point of the fiber web on the last drying cylinder before the calender 15 and the first contact point of the fiber web on the first calender roll forming calendering nip of the calender 15 it is 7-20 m, advantageously 10-15 m.

Figure 5:
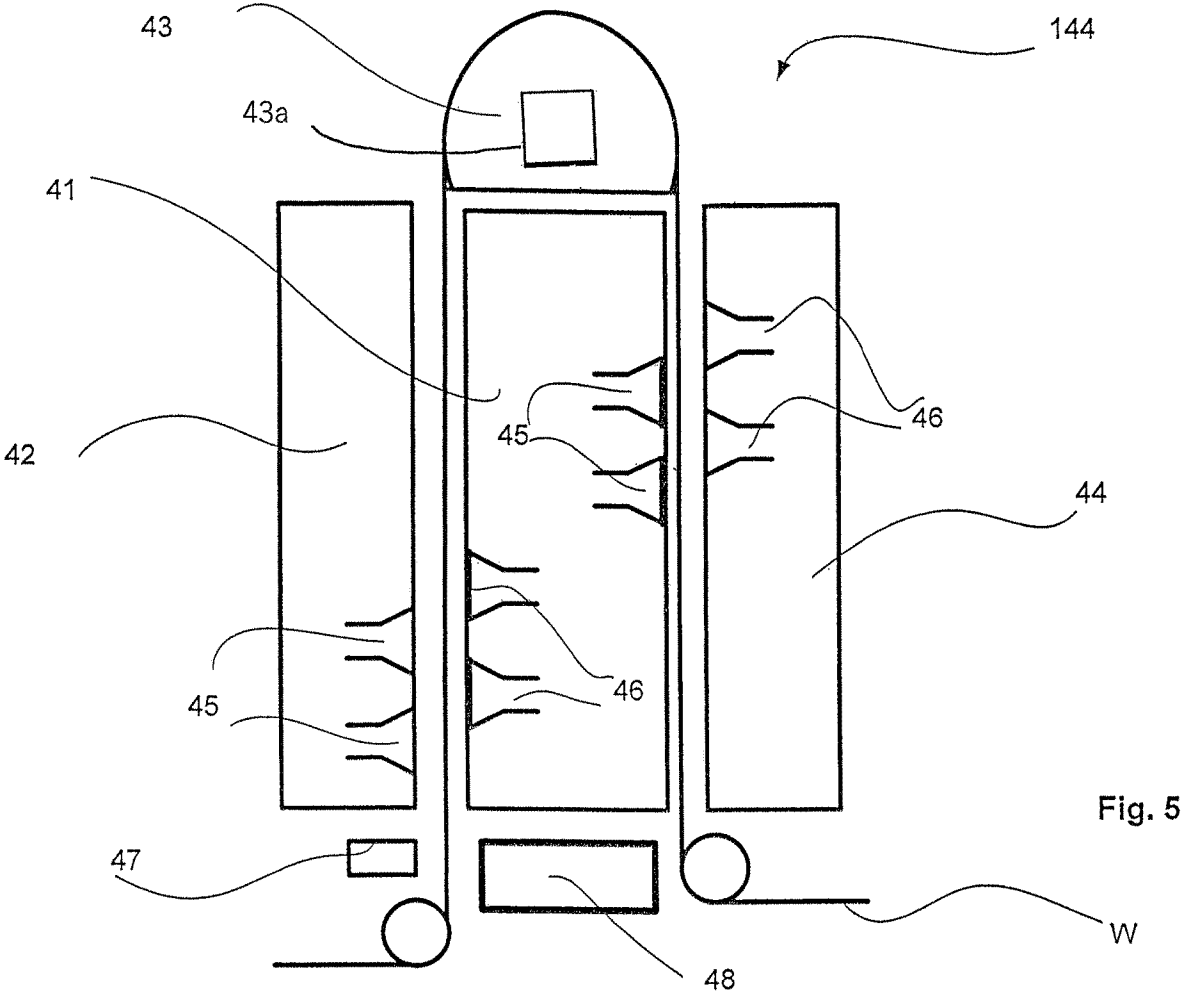
FIG. 5 is schematically shown as an advantageous example of a cooler providing gas blows.

As shown in the example of FIG. 5 the cooler 144 providing gas blows comprises cooler modules 41, 42, 43, 44, advantageously impingement drying modules 41, 42, 43, 44 and at least one impingement drying module 43 is curved providing a gas turn module 43 for turning run of the fiber web W from its main running direction, advantageously substantially horizontal direction, 80-190°. As shown in FIG. 5 cooling modules comprise blowing zones formed by nozzles 45, 46, which can have nozzle openings and/or slits in at least one row, in which dry, cool gas is blown towards at least one surface of the fiber web W and suction zones in between the nozzles 45, 46, in which suction zones from the fiber web W evaporated moisture is drawn away from the proximity of the surface of the fiber web W. As shown in FIG. 5 the cooler 144 providing gas blows can comprise cooler modules 41, 42, 44 on both sides of the fiber web W and a gas turn module 43 located inside the curved fiber web run, which gas turn module 43 having gas blows 43*a* directed towards the curved fiber web during the run. The cooler 144 providing gas blows may comprise moisturizing devices 47, 48 for moisturizing at least one surface of the fiber web W. Advantageously in two on opposite sides of the fiber web located cooler modules 41, 42; 41; 44 the nozzles 45, 56 are located such that on the opposite side in respect of the nozzle a suction zone is located.

Figure 6B:
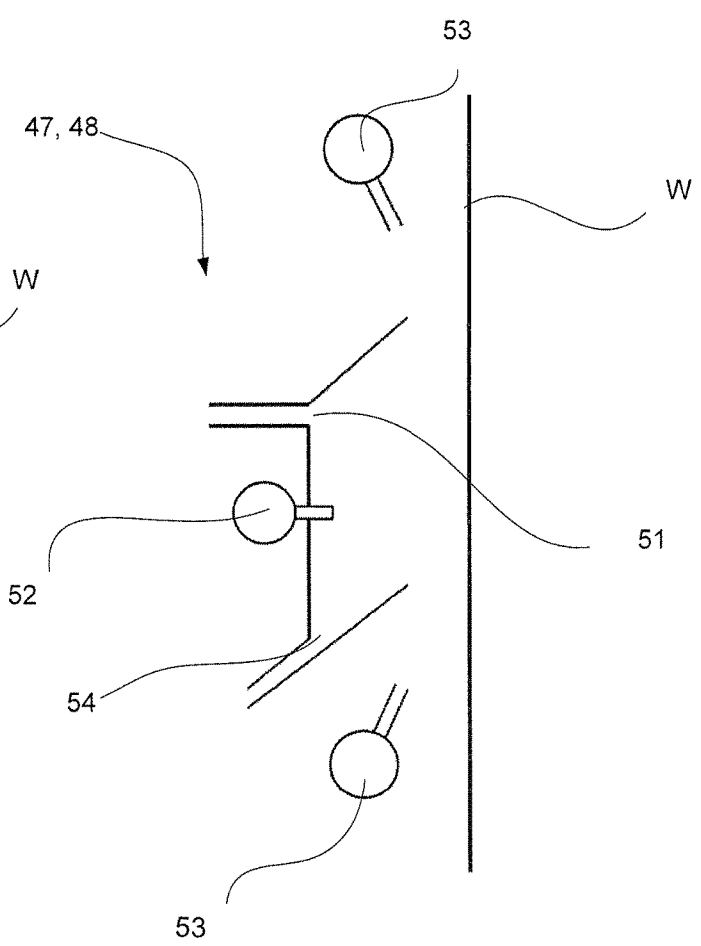
FIGS. 6A-6B are schematically shown side elevational views of advantageous examples of moisturizing devices.
Figure 6A:
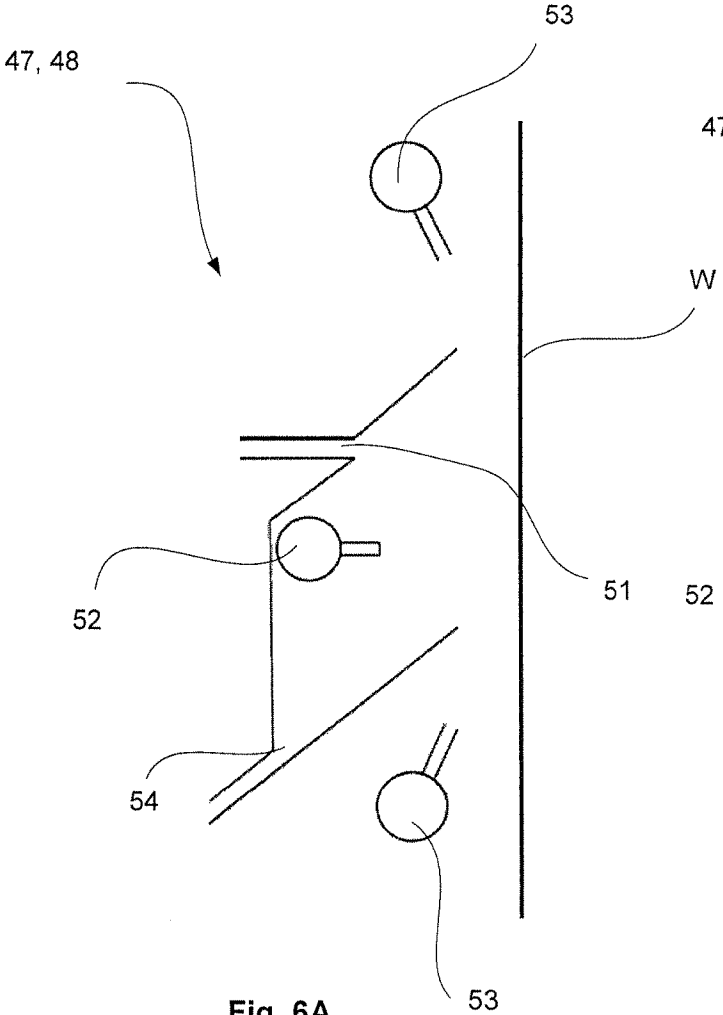

In FIGS. 6A-6B is shown an example of moisturizing devices 47, 48 for the production line comprising a suction zone 51 that extends to the substantial width of the fiber web W, which suction zone 51 is located advantageously between moisturizing nozzles 52 of the moisturizing device 47, 48 and outlet end of the moisturizing device 47, 48. The outlet end of the moisturizing device 47, 48 comprises a nozzle 53 for forming a sealing blow. As can be seen in FIGS. 6A-6B inner surfaces of the moisturizing device 47, 48 susceptible for moisture adherence are directed at least 15° downwards. At lower most point of the moisturizing device a drain connection 54 is located.

In this description and the following claims by fiber webs are meant for example paper and board webs.

A cooler module is a part of a device for cooling a fiber web which has blowing nozzle for cooling the web nozzle for reducing the moisture content of the fiber web surface so as to cool the fiber web below the plastic zone.

Above only some advantageous examples of the invention have been described to which examples the invention is not to be narrowly limited and many modifications and alterations are possible within the invention.

We claim:

1. A fiber web cooler, for a fiber web, the fiber web defining a cross machine direction perpendicular to a travel direction of the web, and width in the cross machine direction, and first and second opposed sides, and a first fiber web temperature before entering the fiber web cooler, comprising:

a first cooler module, a second cooler module positioned opposite each other;

a third cooler module positioned between and below, or between and above, the first cooler module and the second cooler module;

wherein the third cooler module is positioned in fiber web receiving relation to the first cooler module, and the third cooler module is positioned in fiber web transmitting relation to the second cooler module;

therein the third cooler module forms a gas turn module having a curved surface extending through a wrap angle of 80-190°, which curved surface is a non-contact surface with respect to the web, and the third cooler module has gas blows connected to a source of dry gas at a temperature less than the first fiber web temperature, directed at the fiber web on the curved non-contact surface as the fiber web traverses the angle of 80-190°.

2. The fiber web cooler of claim 1 wherein the curved surface of the third cooler extending through an angle of 180°.

3. The fiber web cooler of claim 1 further comprising a fourth cooler module which is positioned between the first cooler module and second cooler module so that the fiber web is cooled on both opposed sides as the web transits the fiber web cooler.

4. The fiber web cooler of claim 3 further comprising a moisturizing device connected to a source of moisture positioned to moisturize the at least one surface of the fiber web before the first cooler module.

5. The fiber web cooler of claim 4 further comprising two moisturizing devices connected to a source of moisture positioned to moisturize both surfaces of the surface of the fiber web before the first cooler module.

6. The fiber web cooler of claim 1 wherein at least the first and second cooler modules have at least one moisturizing device having a moisturizing nozzle connected to a source of moisture and directed toward the fiber web to increase the moisture of the fiber web as it transits the first and second cooler modules;

wherein the at least one moisturizing device has a suction zone connected to a source of suction between two rows of nozzle openings in the cross machine direction connected to the source of cooling gas of a temperature which is less than the first fiber web temperature.

7. The fiber web cooler of claim 6 wherein a plurality of inner surface within each of the first and second cooler modules which define each of the suction zones and the inner surfaces of the moisturizing device which inner surfaces are hydrophilic are directed at least 15° downwardly with respect to a vertical direction defined by gravity.

8. The fiber web cooler of claim 6 wherein the source of dry gas has an adjustable temperature.

* * * * *